US012613071B1

(12) United States Patent
Damoth et al.

(10) Patent No.: US 12,613,071 B1
(45) Date of Patent: Apr. 28, 2026

(54) CONTROL-TILT FOLLOWER FOR A FIREARM MAGAZINE

(71) Applicant: Amend2, LLC, Idaho Falls, ID (US)

(72) Inventors: Austin Damoth, Idaho Falls, ID (US); Craig Lockwood, Idaho Falls, ID (US); Colby Coombs, Idaho Falls, ID (US)

(73) Assignee: Amend2, LLC, Idaho Falls, ID (US)

( * ) Notice: Subject to any disclaimer, the term of this patent is extended or adjusted under 35 U.S.C. 154(b) by 0 days.

(21) Appl. No.: 19/073,514

(22) Filed: Mar. 7, 2025

(51) Int. Cl.
*F41A 9/65* (2006.01)
*F41A 9/70* (2006.01)

(52) U.S. Cl.
CPC ..... *F41A 9/70* (2013.01)

(58) Field of Classification Search
CPC ..... F41A 9/70; F41A 9/65; F41A 9/69; F41A 9/62; F41A 9/83
USPC ..... 42/50
See application file for complete search history.

(56) References Cited

U.S. PATENT DOCUMENTS

| | | | | |
|---|---|---|---|---|
| 2,217,848 | A * | 10/1940 | Schillstrom | F41A 9/69 42/50 |
| 3,226,869 | A * | 1/1966 | Musgrave | F41A 9/69 42/50 |
| 4,589,218 | A * | 5/1986 | Teppa | F41A 9/69 42/50 |
| 7,533,483 | B1 * | 5/2009 | Alzamora | F41A 9/65 89/197 |
| 8,739,446 | B2 * | 6/2014 | Sullivan | F41A 9/69 42/50 |
| 8,991,086 | B2 * | 3/2015 | Fitzpatrick | F41A 9/62 42/50 |
| 11,150,041 | B2 * | 10/2021 | Nakayama | F41A 9/70 |
| 2014/0352189 | A1 * | 12/2014 | Fitzpatrick | F41A 9/83 42/50 |
| 2020/0292262 | A1 * | 9/2020 | Nakayama | F41A 9/70 |

* cited by examiner

*Primary Examiner* — Michael D David
(74) *Attorney, Agent, or Firm* — Travis Banta; Ascent IP Law

(57) ABSTRACT

A control-tilt follower for a firearm magazine includes a first leg and a second leg. The first leg and the second leg are flexible which allows the follower to tilt upwardly and downwardly inside a firearm magazine. The first leg includes an indent. The second leg includes a protrusion. A follower retainer is disposed on a side of the follower to act as a guide for the follower to move up and down the firearm magazine. The follower connects to a spring inside the firearm magazine.

20 Claims, 4 Drawing Sheets

CONTROL-TILT FOLLOWER FOR A FIREARM MAGAZINE

BACKGROUND

The earliest firearms operated as single shot firearms, which means these firearms had to be manually reloaded with each constituent element of ammunition after firing. Specifically, these firearms required that gun powder be inserted through the muzzle (the front) and a barrel of the firearm. A wad was next inserted into the barrel to separate the gun powder from a projectile. A projectile was finally loaded on top of the wad. A spark was created by an ember, a flint, or other device that triggered the gunpowder in the barrel to ignite. Igniting gun powder increased pressure inside the barrel which forced the projectile out of the barrel at the muzzle at high velocity. Reloading required putting new gun powder in the muzzle, a new wad, and a new projectile.

While many well trained soldiers were capable of reloading quickly, a fast firing rate of these types of firearms was considered to be around three shots per minute with a single shot firearm. Innovations in firearm technology helped increase firing speed. Firing speed is largely dictated by how fast a new projectile can be installed in a chamber of a firearm. Repeating rifles were one of the innovations that drastically increased firing speed. Revolvers also increased firing speed. Both the repeating rifle and the revolver used a new innovation in firearm technology, referred to as a magazine. Magazines, at least in the context of revolvers and single shot rifles, are devices that hold ammunition in position to be fired before the ammunition is fired. One example of a magazine in a repeating rifle is a tube in, for example, a lever action rifle, which holds ammunition cartridges in a line (projectile to primer) in the tube. As the lever of the lever action rifle is actuated, a single cartridge is taken from the magazine and inserted into a breech of the lever action rifle. As the lever on the lever action rifle is closed, a firearm bolt pushes the ammunition into position in a chamber of the rifle for firing. This process can be repeated until the magazine tube is empty.

Similarly, a revolver may include a device called a cylinder, which functions as a magazine. Conventional cylinders included six holes which allowed up to six shots to be loaded in the cylinder. The firearm could then be fired up to six times without reloading by rotating the cylinder to position the next hole in line with a firearm barrel and causing the gun powder to ignite. Alignment of the cylinder with the barrel in a revolver is critical to proper function of the revolver.

Around the dawn of the $20^{th}$ century, innovations in firearms resulted in the creation of a removable firearm magazine which were used in both pistols and rifles. Removable firearm magazines allowed brass ammunition cartridges to be installed and retained within the magazine. Removable firearm magazines generally consist of a body, a spring, and a follower. The spring is placed inside the body and typically attached to the follower. The follower forms an interface between the ammunition cartridges held in the body and the magazine. As ammunition cartridges are inserted into the magazine, the follower is pushed down, compressing the spring. As ammunition cartridges are removed from the magazine, spring pressure forces the follower up in the body until the magazine is empty of ammunition cartridges.

Early removable magazines were known to cause some misfires because the follower frequently failed to position an ammunition cartridge correctly in a firearm for the firearm bolt to load the ammunition cartridge into the chamber of the firearm. Conventions also necessitated magazines capable of holding more ammunition than were available.

Magazines were further innovated to address the issues of misfires and increased capacity for magazines. Since ammunition cartridges are stacked within the body of the magazine, and the ammunition cartridges have a specific size, the body of the magazine must also have a minimum size dictated by the number of magazine cartridges that can be held in the magazine. Magazines that held 10 rounds of ammunition were fairly small regardless of the size of the ammunition cartridges in the magazine. However, as 20 and 30 round magazines were developed, these magazines became too long for shooting comfort. As a result, magazines began to be curved to increase shooter comfort with larger capacity magazines.

Correcting the issue of misfires was linked to magazine shape, in that the follower of the magazine had to be fixed in position to push ammunition cartridges into position to be chambered by a bolt of the firearm. If the follower is out of position, the ammunition cartridge will not be loaded correctly by the firearm, which would cause a misfire. Magazine followers require even spring pressure across the length of the follower and particular alignment inside the body of the magazine. Tilt in the follower has been the root cause of some misfires. In other words, when the follower tilts in the magazine (e.g., is not level), the ammunition cartridge being held in the magazine cannot properly be removed by the firearm and loaded into the chamber of the firearm.

To solve this problem, an anti-tilt follower was created. These anti-tilt followers include tongues and grooves on the front and back of the follower to interact with corresponding ribs in the body of the magazine. These ribs limit the ability of the follower to move out of level within the body of the magazine. The anti-tilt followers must be particularly rigid to ensure even pressure is applied to the ammunition cartridges across a length of the anti-tilt follower. In magazines having a capacity over 10 rounds, the follower experiences significant tension and pressures as the curve in the magazine prevents the follower from being aligned with or parallel to a bolt in a firearm when fully loaded.

Anti-tilt followers rely on friction between the tongues and grooves to be disposed in a proper position. As a result, followers tend to get worn down by contact with the body of the magazine, causing the followers to have more side to side and front to back movement within the body of the magazine. Over time, these followers can move to the point where they no longer position the ammunition cartridges in position to be fired reliably, and must, therefore, be replaced.

It is one object of this disclosure to provide a control-tilt follower for a firearm magazine. It is another object of this disclosure to provide a control-tilt follower that does not rely on forward and rear tongues and grooves to prevent undesirable tilt. It is another object of this disclosure to provide a control-tilt follower that includes flexible legs to accommodate use in curved magazines. It is another object of this disclosure to provide a control-tilt follower in a magazine that reliably feeds ammunition cartridges into a firearm.

SUMMARY OF THE DISCLOSURE

Disclosed herein is a follower for a firearm magazine. The firearm magazine may include a first leg and a second leg. The first leg and the second leg are flexible and allow the follower to tilt upwardly and downwardly inside a firearm magazine. The first leg and the second leg may flex to an angle of 35 degrees depending on position in the magazine and a caliber of ammunition cartridges disposed inside the magazine.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

In the following description of the disclosure, reference is made to the accompanying drawings, which form a part hereof, and in which is shown by way of illustration specific implementations in which the disclosure may be practiced. It is understood that other implementations may be utilized and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
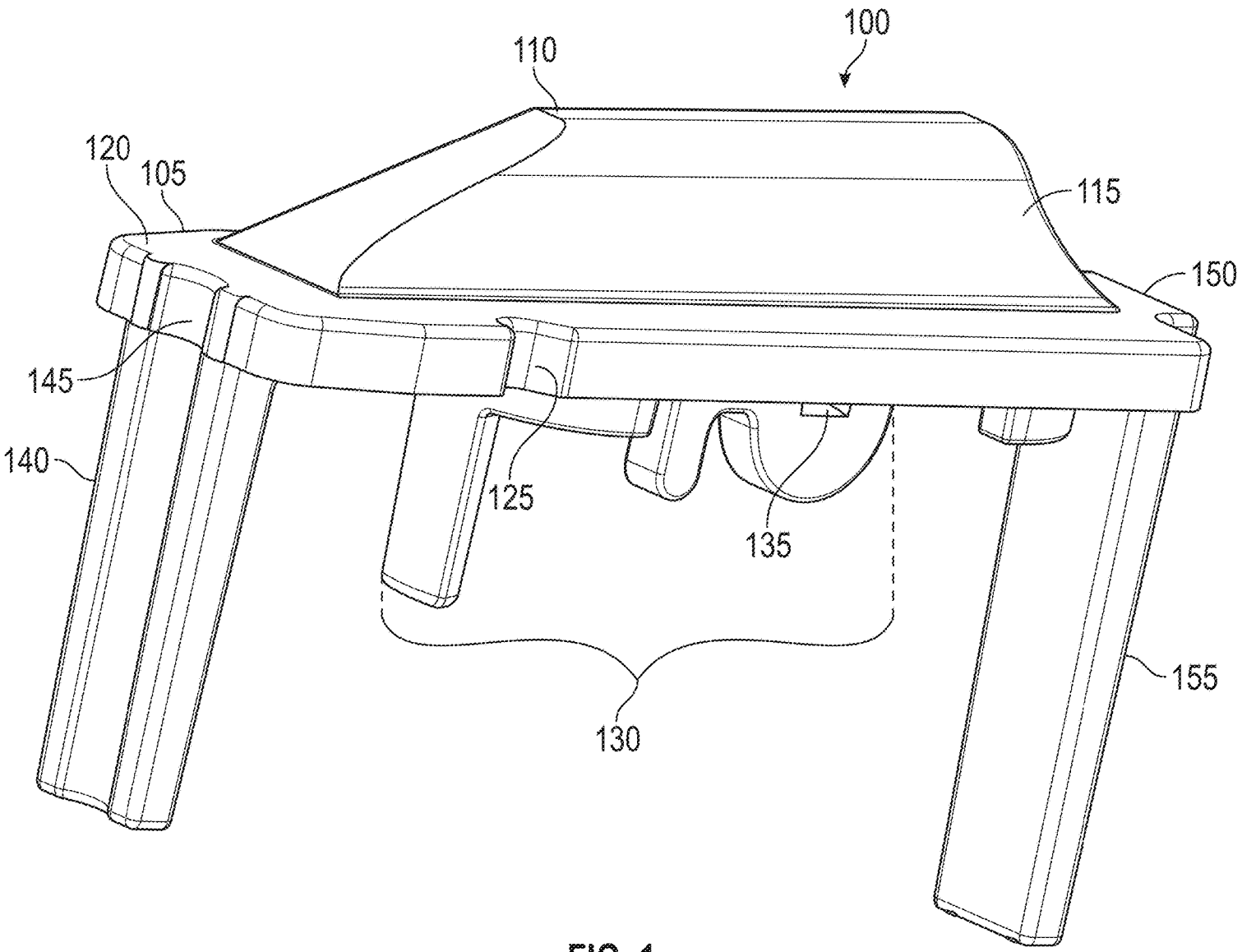
FIG. 1 illustrates a perspective view of a firearm magazine follower.

FIG. 1 illustrates a perspective view of a firearm magazine follower 100. While follower 100 is implemented as a single piece element, follower 100 may have two separate sections, such as base section 105 and top section 110. Base section 105 may be a portion of follower 100 that generally interacts with a body of a magazine (not shown) while top section 110 interfaces with one or more cartridges stored in the magazine body. For example, top section 110 may include a ramp 115 which operates to push an ammunition cartridge to one side of the magazine body, causing the next ammunition cartridge to be offset from the previous one. In this manner each subsequent cartridge of ammunition is offset from the next all the way through the magazine body. Table 120 is disposed at a base of ramp 115 and provides a resting surface for the bottom most ammunition cartridge in a magazine body.

Follower 100 may be constructed from various materials. For example, follower 100 may be constructed from acetal based plastics, Duramide™ (an amorphous and/or glass filled nylon with impact modification), a glass reinforced polymer, and/or other similar materials known to those of ordinary skill in the art. Follower 100 may be a bi-material construction using different materials to implement different parts of follower 100. For example, ramp 115 and table 120 may be constructed from one material, while first leg 140 and second leg 155 may be made from another material, while still being constructed a single piece element.

Follower 100 may further include an indented follower retainer 125 which is disposed in a top and side of table 120. Follower retainer 125 may be indented into table 120 such that the follower retainer extends inwardly from an outside periphery of table 120 of follower 100. Table 120 is not continuous along a side of follower 100 due to follower retainer 125 indenting into the side of table 120 in follower 100.

Follower 100 further includes a spring connector 130 which interfaces with a spring (not shown) within a magazine body (not shown). Spring connector 130 relies on the spring to push follower 100 up when an ammunition cartridge is removed from the magazine. Spring connector 130 may include a spring attachment 135 where at least one portion of the spring may attach to follower 100. Spring connector 130 may be sized to allow a magazine spring to surround spring connector 130 and attach to spring connector 130 and follower 100 by spring attachment 135. Spring connector 130 may be disposed on a bottom side of follower 100.

Follower 100 may include a first leg 140 disposed on a front side of follower 100. First leg 140 may include an indexing indent 145 which may correspond to a corresponding element in the magazine body. Indexing indent 145 may be disposed on a front side of first leg 140 and extend from a bottom of first leg 140 to a top of first leg 140 and through table 120. As shown in FIG. 1, first leg 140 is disposed in an un-flexed state. However, first leg 140 is flexible to facilitate controlled tilt in follower 100. For example, first leg 140 may flex to a position that is up to 35 degrees from its position in an unflexed state toward spring connector 130, which may be 90 degrees relative to table 120. In other words, first leg 140 may flex in a direction towards spring connector 130 to an angle of up to 55 degrees relative to table 120. The ability of first leg 140 to flex will further be discussed with respect to FIG. 4.

Follower 100 may further include a second leg 155 which incorporates a centering protrusion 155. Protrusion 155 may extend outwardly from a back portion of second leg 155 and extend from a bottom of second leg 155 to a top of table 150. At least a portion of protrusion 155 may interact further with a corresponding channel in a magazine body. As shown in FIG. 1, second leg 1 is disposed in an un-flexed state. However, second leg 155 is flexible to facilitate controlled tilt in follower 100. For example, second leg 155 may flex to a position that is up to 35 degrees from its position in an unflexed state toward spring connector 130, which may be 90 degrees relative to table 120. In other words, second leg 155 may flex in a direction towards spring connector 130 to an angle of up to 55 degrees relative to table 120. The ability of second leg 155 to flex will further be discussed with respect to FIG. 4.

First leg 140 and second leg 155, respectively, may ensure that at least a portion of indent 145 and protrusion 150 remain in contact with a magazine body regardless of how first leg 140 and second leg 155 are flexed. While examples of flex will be discussed with respect to FIG. 4, it is noted that follower 100 may be universal to any caliber of ammunition cartridges. For example, follower 100 may be sized to accommodate any caliber of ammunition cartridges in a magazine body. More specifically, first leg 140 and second leg 155 may flex at different rates depending on a size of the ammunition cartridge held by a magazine. For example, because a .223 Rem caliber ammunition cartridge is smaller than a 30 caliber cartridge in terms of diameter, first leg 140 and second leg 155 may be disposed at a greater angle relative to table 120 when 30 caliber ammunition is used than when .223 Rem caliber ammunition is used in the magazine. Further, the relative flex of both first leg 140 and second leg 155 may also be determined by a position of follower 100 in the magazine and the number of cartridges disposed inside the magazine. In any case, follower 100 may be universal to use in any ammunition caliber desired so long as follower 100 is correspondingly sized to a particular desired ammunition caliber in that follower 100 implementing first leg 140 and second leg 155 may flex to accommodate any desired caliber for a firearm magazine.

Figure 2:
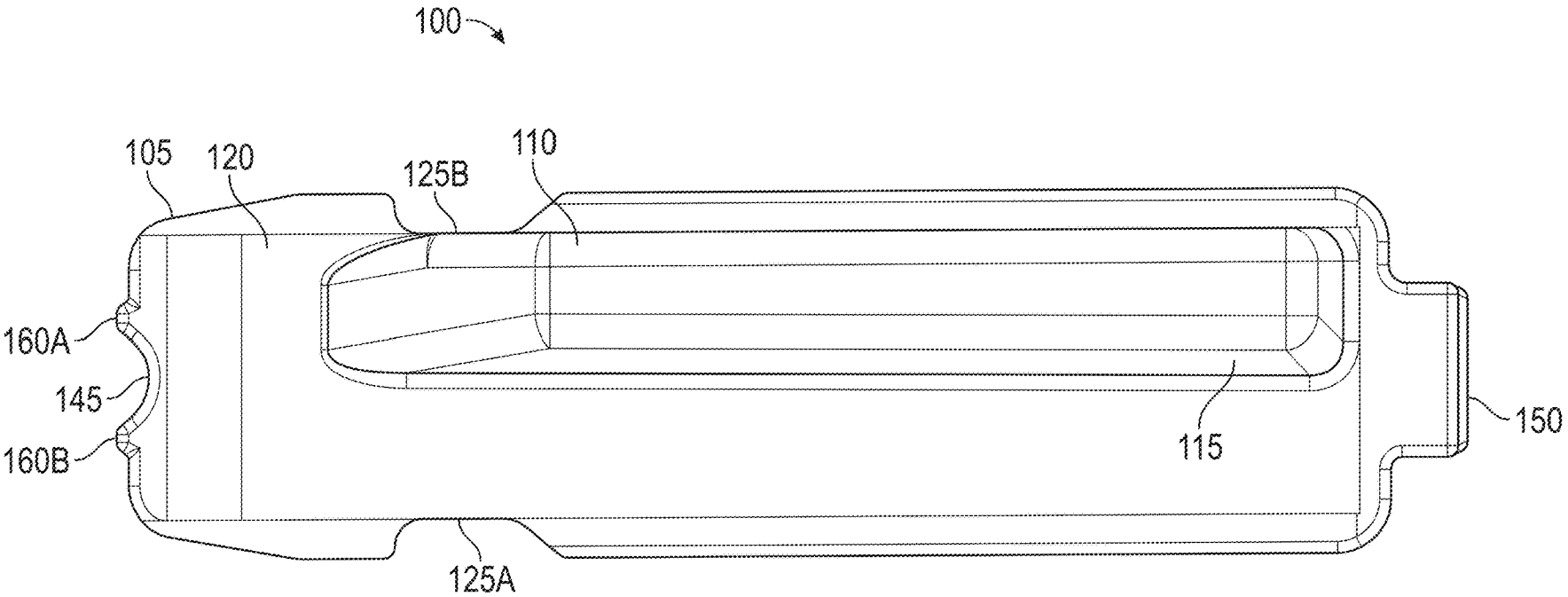
FIG. 2 illustrates a top view of a firearm magazine follower.

FIG. 2 illustrates a top view of a magazine follower 100. While follower 100 is implemented as a single piece element, follower 100 may have two separate sections, such as base section 105 and top section 110. Base section 105 may be a portion of follower 100 that generally interacts with a body of a magazine (not shown) while top section 110 interfaces with one or more cartridges stored in the magazine body. For example, top section 110 may include a ramp 115 which operates to push an ammunition cartridge to one side of the magazine body, causing the next ammunition cartridge to be offset from the previous one. In this manner each subsequent cartridge of ammunition is offset from the next all the way through the magazine body. Table 120 is disposed at a base of ramp 115 and provides a resting surface for the bottom most ammunition cartridge in a magazine body.

Follower 100 may be constructed from various materials. For example, follower 100 may be constructed from acetal based plastics, Duramide™ (an amorphous and/or glass filled nylon with impact modification), a glass reinforced polymer, and/or other similar materials known to those of ordinary skill in the art. Follower 100 may be a bi-material construction using different materials to implement different parts of follower 100. For example, Ramp 115 and table 120 may be constructed from one material, while first leg 140 and second leg 155, shown in FIG. 1, may be made from another material, while still being constructed a single piece element.

Follower 100 may further include an indented follower retainers 125A and 125B which are disposed in a top and respective sides of table 120. Follower retainers 125A and 125B may be indented into table 120 such that the follower retainer extends inwardly from an outside periphery of table 120 of follower 100. Table 120 is not continuous along a side of follower 100 due to follower retainers 125A and 125B indenting into the side of table 120 in follower 100. As shown in FIG. 2, follower retainers 125A and 125B may include a curve on a front section of the follower retainers 125A and 125B and an angular line on a back section of follower retainers 125A and 125B. Follower retainers 125A and 125B function as guides for follower 100 to travel up and down a magazine body by interfacing with one or more corresponding guides in the magazine body. However, since follower 100 may tilt within the magazine body, follower retainers 125A and 125B may be larger than the corresponding guides in the magazine body. The curves in the front of follower retainers 125A and 125B may provide pivot points for the follower as it tilts while the angular line on the back section of follower retainers 125A and 125B may allow for follower 100 to tilt without being obstructed by the angular line on the back section of follower retainers 125A and 125B. In other words, follower retainers 125A and 125B allow follower 100 to tilt while also acting as guides for follower 100 to travel up and down a magazine body.

As further shown in FIG. 2, follower 100 may include an indexing indent 145 which may correspond to a corresponding element in the magazine body. Indexing indent 145 may be disposed on a front side of first leg 140 and extend from a bottom of first leg 140 to a top of first leg 140 and through table 120. Indexing indent 145 may be arcuate in shape. Follower 100 may further include a first bumper 160A and second bumper 160B disposed on opposing sides of indexing indent 145. First bumper 160A and second bumper 160B may be disposed as the frontmost portion of follower 100 and operate to maintain the position of indexing indent 145 in contact with the corresponding element of the magazine body. First bumper 160A and second bumper 160B may further extend from a top of table 120 to a bottom of first leg 140.

Follower 100 may further include a second leg 155 which incorporates a centering protrusion 155. Protrusion 155 may extend outwardly from a back portion of second leg 155 and extend from a bottom of second leg 155 to a top of table 150. At least a portion of protrusion 155 may interact further with a corresponding channel in a magazine body.

Figure 3:
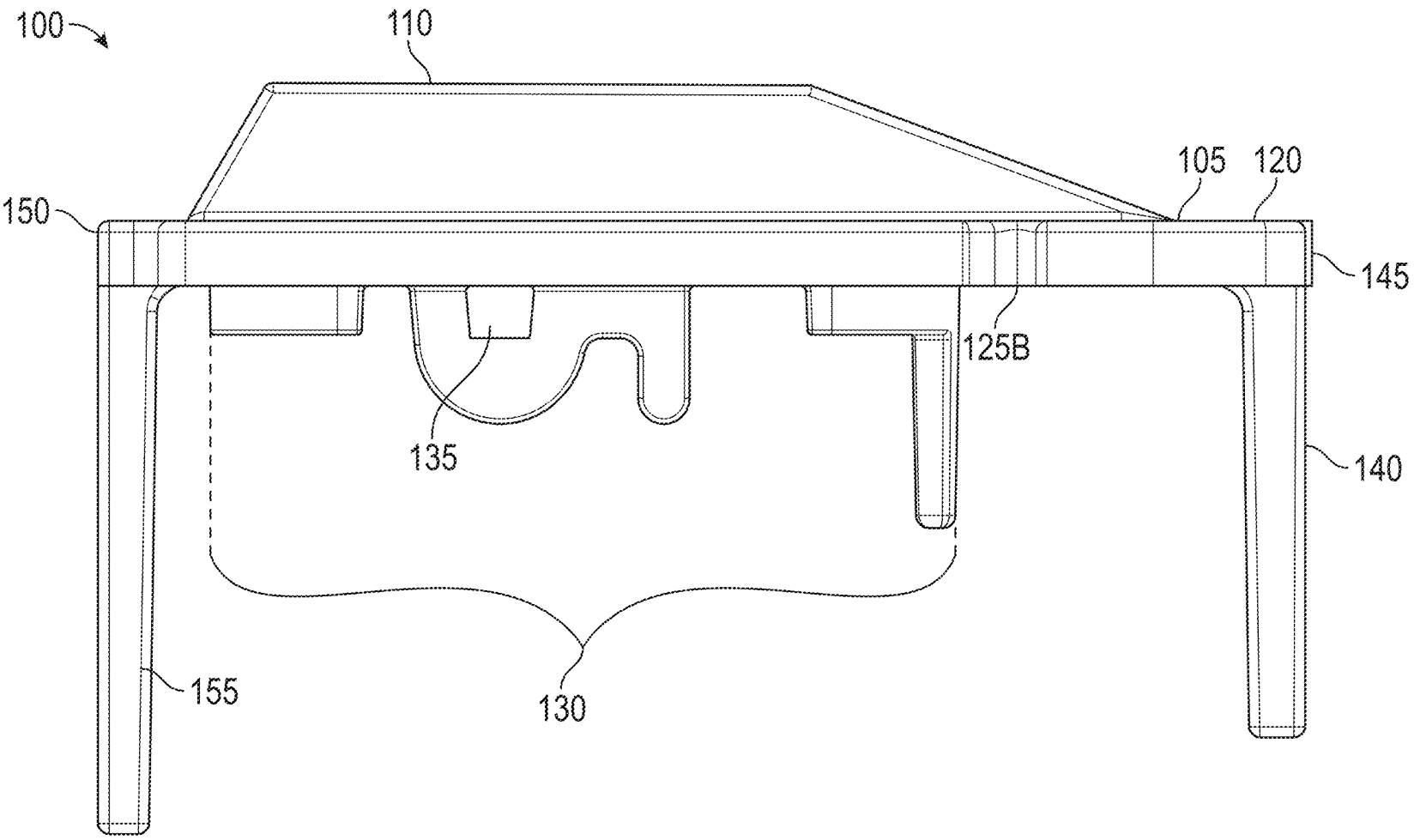
FIG. 3 illustrates a side view of a firearm magazine follower.

FIG. 3 illustrates a side view of a firearm magazine follower 100. While follower 100 is implemented as a single piece element, follower 100 may have two separate sections, such as base section 105 and top section 110. Base section 105 may be a portion of follower 100 that generally interacts with a body of a magazine (not shown) while top section 110 interfaces with one or more cartridges stored in the magazine body.

Follower 100 may be constructed from various materials. For example, follower 100 may be constructed from acetal based plastics, Duramide™ (an amorphous and/or glass filled nylon with impact modification), a glass reinforced polymer, and/or other similar materials known to those of ordinary skill in the art. Follower 100 may be a bi-material construction using different materials to implement different parts of follower 100. For example, table 120 may be constructed from one material, while first leg 140 and second leg 155 may be made from another material, while still being constructed a single piece element.

Follower 100 may further include an indented follower retainer 125B which is disposed in a top and side of table 120. Follower retainer 125B may be indented into table 120 such that the follower retainer extends inwardly from an outside periphery of table 120 of follower 100. Table 120 is not continuous along a side of follower 100 due to follower retainer 125 indenting into the side of table 120 in follower 100. A corresponding follower retainer 125A, is shown in FIG. 1 and FIG. 2.

Follower 100 further includes a spring connector 130 which interfaces with a spring (not shown) within a magazine body (not shown). Spring connector 130 relies on the spring to push follower 100 up when an ammunition cartridge is removed from the magazine. Spring connector 130 may include a spring attachment 135 where at least one portion of the spring may attach to follower 100. Spring connector 130 may be sized to allow a magazine spring to surround spring connector 130 and attach to spring connector 130 and follower 100 by spring attachment 135. Spring connector 130 may be disposed on a bottom side of follower 100.

Follower 100 may include a first leg 140 disposed on a front side of follower 100. First leg 140 may include an indexing indent 145 which may correspond to a corresponding element in the magazine body. Indexing indent 145 may be disposed on a front side of first leg 140 and extend from a bottom of first leg 140 to a top of first leg 140 and through table 120. As shown in FIG. 1, first leg 140 is disposed in an un-flexed state. However, first leg 140 is flexible to facilitate controlled tilt in follower 100. For example, first leg 140 may flex to a position that is up to 35 degrees from its position in an unflexed state toward spring connector 130, which may be 90 degrees relative to table 120. In other words, first leg 140 may flex in a direction towards spring connector 130 to an angle of up to 55 degrees relative to table 120. The ability of first leg 140 to flex will further be discussed with respect to FIG. 4.

Follower 100 may further include a second leg 155 which incorporates a centering protrusion 155. Protrusion 155 may extend outwardly from a back portion of second leg 155 and extend from a bottom of second leg 155 to a top of table 150. At least a portion of protrusion 155 may interact further with a corresponding channel in a magazine body. As shown in FIG. 1, second leg 1 is disposed in an un-flexed state. However, second leg 155 is flexible to facilitate controlled tilt in follower 100. For example, second leg 155 may flex to a position that is up to 35 degrees from its position in an unflexed state toward spring connector 130, which may be 90 degrees relative to table 120. In other words, second leg 155 may flex in a direction towards spring connector 130 to an angle of up to 55 degrees relative to table 120. The ability of second leg 155 to flex will further be discussed with respect to FIG. 4.

First leg 140 and second leg 155, respectively, may ensure that at least a portion of indent 145 and protrusion 150 remain in contact with a magazine body regardless of how first leg 140 and second leg 155 are flexed. While examples of flex will be discussed with respect to FIG. 4, it is noted that follower 100 may be universal to any caliber of ammunition cartridges. For example, follower 100 may be sized to accommodate any caliber of ammunition cartridges in a magazine body. More specifically, first leg 140 and second leg 155 may flex at different rates depending on a size of the ammunition cartridge held by a magazine. For example, because a .223 Rem caliber ammunition cartridge is smaller than a 30 caliber cartridge in terms of diameter, first leg 140 and second leg 155 may be disposed at a greater angle relative to table 120 when 30 caliber ammunition is used than when .223 Rem caliber ammunition is used in the magazine. Further, the relative flex of both first leg 140 and second leg 155 may also be determined by a position of follower 100 in the magazine and the number of cartridges disposed inside the magazine. In any case, follower 100 may be universal to use in any ammunition caliber desired so long as follower 100 is correspondingly sized to a particular desired ammunition caliber in that follower 100 implementing first leg 140 and second leg 155 may flex to accommodate any desired caliber for a firearm magazine.

Figure 4:
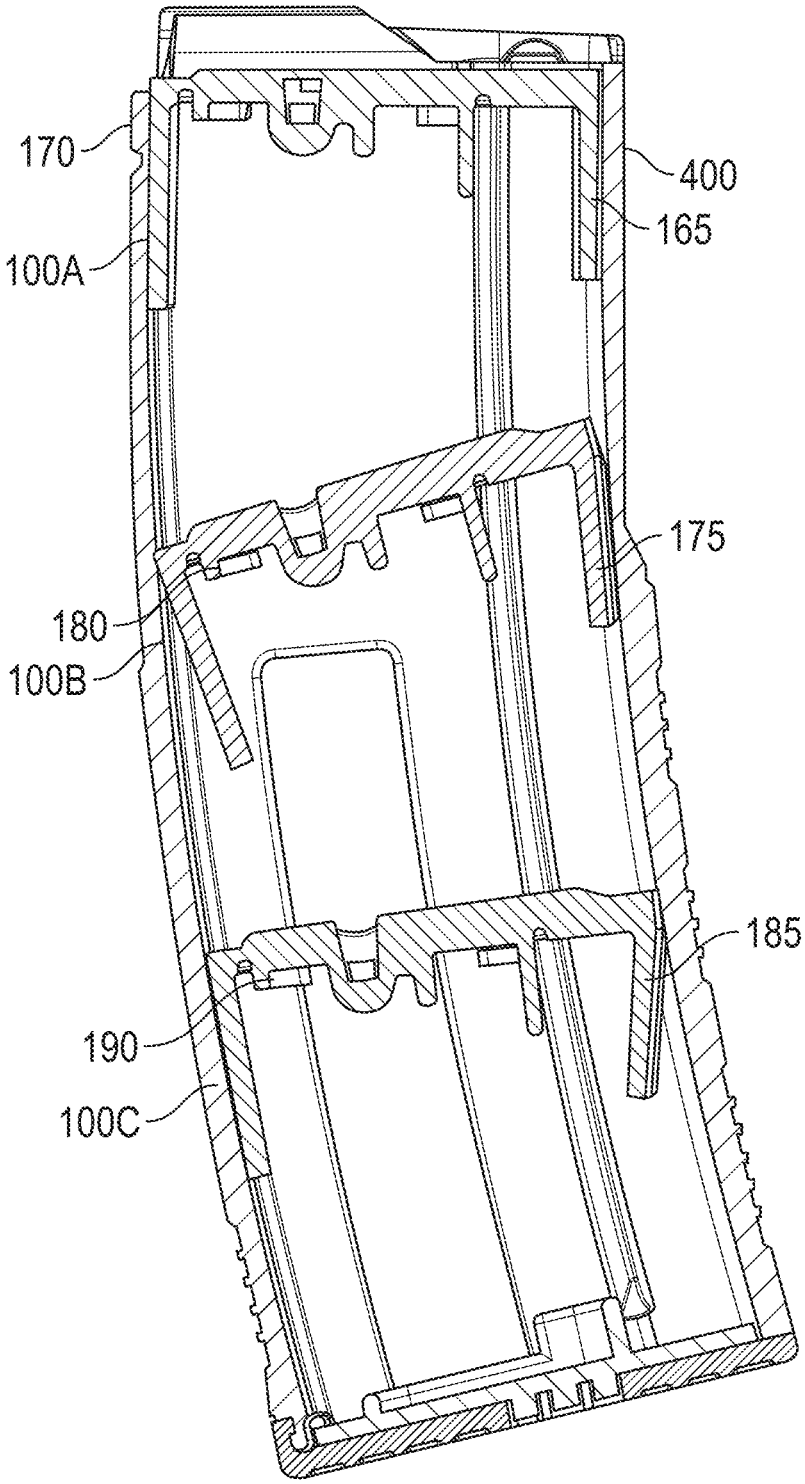
FIG. 4 illustrates a firearm magazine follower in various positions inside a body of a firearm magazine.

FIG. 4 illustrates a firearm magazine follower 100 in various positions inside a body of a firearm magazine 400. For example, magazine follower 100 is shown at a top of magazine body 400 as magazine follower 100A, at an approximate mid-point of magazine body 400 as magazine follower 100B, and at an approximate bottom of a magazine body 400 as magazine follower 100C. As shown in FIG. 4, magazine follower 100A is disposed at a top of magazine body 400. Magazine follower 100A is illustrated in a position where first leg 140 and second leg 155, shown in FIG. 1 and FIG. 3, are in an un-flexed state. In other words, both first leg 140 and second leg 155 are disposed at an angle of 90 degrees relative to table 120, shown in FIG. 1, FIG. 2, and FIG. 3. An angle 165 of first leg 140 is illustrated as being a right angle in FIG. 4. An angle 170 of second leg 155 is also illustrated as being a right angle in FIG. 4. Since no ammunition cartridges have been disposed on top of magazine follower 100A, and since magazine follower 100A is not compensating for curve in magazine body 400, first leg 140 and second leg 150 are in an un-flexed state. Follower 100 is not tilted at the top of the magazine and is parallel to a top of magazine body 400.

As magazine follower 100 is pushed down in magazine body 400. As shown as magazine follower 100B, an angle of both first leg 140 and second leg 155 changes based on a diameter of the ammunition being disposed within magazine body 400, the position of follower 100B in magazine body 400, the amount of flexibility available in first leg 140 and second leg 155. In maximum conditions, first leg 140 and second leg 155 may flex up to 35 degrees to accommodate large caliber ammunition and maximum curvature of magazine body 400. However, as shown, first leg 140 of follower 100B may be disposed at an angle θ 175 which may be approximately 15 degrees. As first leg 140 is flexed, second leg 155 of follower 100B may flex in a corresponding fashion, as required. However, as shown in FIG. 4, angle θ 180 is shown as a 90 degree angle. It is noted that a table portion of follower 100B does not contact magazine body 400 on a front side of follower 100B due to the flex of first leg 140. However, bumpers 165A and 165B, along with indexing indent 145 disposed on first leg 140 may still be in contact with magazine body 400. At a rear portion of follower 100B, a table 120 is in contact with magazine body 100B and protrusion 155 extends into a recess within magazine body 400. Follower 100B is tilted upwardly in magazine body 400 in a controlled manner.

As follower 100 moves to a bottom portion of magazine body 400, to the position of magazine follower 100C, flexing of first leg 140 becomes more pronounced, having an angle θ 185 of approximately 30 degrees. At the same time, second leg 155 is compressed such that second leg 155 flexes to an angle θ 190 of 10 degrees. Follower 100C is tilted downwardly in magazine body 400 in a controlled manner. Bumpers 165A and 165B, table 120, and indent 145 interface with magazine body 400 while a lower section of front leg does not interface with magazine body 400. At the same time, protrusion 155, table 120, and second leg 155 interface with magazine body 400.

In this manner, a controlled-tilt follower 100 may flex first leg 140 and/or second leg 155 to tilt upwardly or downwardly in magazine body 400.

The foregoing description has been presented for the purposes of illustration and description. It is not intended to be exhaustive or to limit the disclosure to the precise form disclosed. Many modifications and variations are possible in light of the above disclosure and teachings. Further, it should be noted that any or all of the aforementioned alternate implementations may be used in any combination desired to form additional hybrid implementations of the disclosure. For example, components described herein may be removed and other components added without departing from the scope or spirit of the embodiments disclosed herein or the appended claims.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

What is claimed is:

1. A follower for a firearm magazine, comprising:

a first leg;

a second leg; and a table;

wherein the first leg and the second leg flex as the follower moves in the firearm magazine and the first leg and second leg are contacted by curvature in the firearm magazine which causes the table to tilt upwardly and downwardly in the firearm magazine.

2. The follower for a firearm magazine of claim 1, wherein the first leg includes an indexing indent.

3. The follower for a firearm magazine of claim 2, wherein the first leg includes one or more bumpers on the first leg.

4. The follower for a firearm magazine of claim 3, wherein the one or more bumpers are disposed on a side of the indexing indent on the first leg.

5. The follower for a firearm magazine of claim 2, wherein the indexing indent extends from a top of the table of the follower to a bottom of the first leg.

6. The follower for a firearm magazine of claim 1, wherein the second leg includes a protrusion.

7. The follower for a firearm magazine of claim 6, wherein the protrusion extends from a top of the table of the follower to a bottom of the second leg.

8. The follower for a firearm magazine of claim 1, wherein the first leg flexes up to an angle of 35 degrees from an un-flexed state.

9. The follower for a firearm magazine of claim 1, wherein the second leg flexes up to an angle of 35 degrees from an un-flexed state.

10. The follower for a firearm magazine of claim 1, further comprising a ramp.

11. The follower for a firearm magazine of claim 10, wherein the first leg extends from the table.

12. The follower for a firearm magazine of claim 10, wherein the second leg extends from the table.

13. The follower for a firearm magazine of claim 1, further comprising a spring connector.

14. The follower for a firearm magazine of claim 13, wherein the first leg flexes towards the spring connector.

15. The follower for a firearm magazine of claim 13, wherein the second leg flexes towards the spring connector.

16. The follower for a firearm magazine of claim 13, wherein the spring connector further includes a spring attachment.

17. The follower for a firearm magazine of claim 1, further comprising a follower retainer disposed in a side of the follower.

18. The follower for a firearm magazine of claim 17, wherein the follower retainer includes a curved end and an angled line at a back end.

19. The follower for a firearm magazine of claim 17, wherein the follower retainer is a guide for the follower.

20. The follower for a firearm magazine of claim 19, wherein the follower retainer is indented into the follower to allow the follower to tilt upwardly and downwardly in the firearm magazine.

* * * * *